US007380917B2

(12) United States Patent
Terakura

(10) Patent No.: US 7,380,917 B2
(45) Date of Patent: Jun. 3, 2008

(54) INKJET HEAD

(75) Inventor: Tatsuo Terakura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 8 days.

(21) Appl. No.: 10/913,463

(22) Filed: Aug. 9, 2004

(65) Prior Publication Data

US 2005/0036012 A1 Feb. 17, 2005

(30) Foreign Application Priority Data

Aug. 13, 2003 (JP) ..... 2003-292788

(51) Int. Cl.
*B41J 2/045* (2006.01)

(52) U.S. Cl. ..... 347/71

(58) Field of Classification Search ..... 347/68–72; 29/25.35

See application file for complete search history.

(56) References Cited

U.S. PATENT DOCUMENTS 5,631,680 A 5/1997 Sugahara
6,361,155 B1 * 3/2002 Kanda et al. ..... 347/70
6,502,929 B1 * 1/2003 Tanaka et al. ..... 347/71
6,536,879 B2 3/2003 Ito et al.
6,685,305 B2 * 2/2004 Okuda ..... 347/71

FOREIGN PATENT DOCUMENTS

EP 0 956 955 A2 11/1999
JP A-4-263950 9/1992
JP A 2002-096477 4/2002
JP A 2002-96477 4/2002

* cited by examiner

*Primary Examiner*—An H Do
(74) *Attorney, Agent, or Firm*—Oliff & Berridge, PLC

(57) ABSTRACT

An inkjet head includes a flow-path unit. The flow-path unit includes a plurality of plates that are stacked and define a common ink chamber and a plurality of ink flow paths communicating with the common ink chamber. The plurality of plates include a first plate and a second plate that are bonded to each other by an adhesive. The first plate defines a plurality of ink supply holes that make up a part of the ink flow paths. The first plate defines a first groove in a second region other than a first region where the first plate and the second plate contact with each other. The first groove extends in a direction, which intersects with a longitudinal direction of the inkjet head.

22 Claims, 15 Drawing Sheets

INKJET HEAD

BACKGROUND OF THE INVENTION

1. Field of the Invention

The present invention relates to an inkjet head used for an inkjet recording apparatus that ejects ink onto a recording medium to perform printing.

2. Description of the Related Art

Conventionally, there is an inkjet head constructed such that ink supplied from an ink tank to a manifold is distributed to plural pressure chambers, and pulse-like pressures are selectively applied to these plural pressure chambers so that ink is ejected from nozzles communicating with the pressure chambers. In such an inkjet head, a flow path unit including pressure chambers, manifolds, nozzles or ink flow paths for connecting these is constructed by laminating plural plates having openings and holes for forming the pressure chambers and the like.

The plural plates constituting the flow path unit are generally bonded by adhesive and are laminated to each other. When two plates are bonded to each other by applying adhesive to one surface of each of the plates, in order to prevent the surplus adhesive from flowing into openings or holes formed in each of the plates, there has been proposed that escape grooves for escaping the surplus adhesive are formed in the peripheries of the openings or holes (see, for example, JP-A-2002-96477 (FIG. 4)). That is, in the plural plates constituting the flow path unit, the plural escape grooves are formed around each of pressure chambers, manifolds, communication holes for communicating the pressure chambers and the nozzles, and through-holes for communicating the pressure chambers and the manifolds. All of these escape grooves are formed in a bonded area of each of the plates in which the adhesive is directly applied and which is bonded to another plate.

SUMMARY OF THE INVENTION

In the case where the foregoing plural plates are bonded by using the adhesive, the adhesive is generally transferred and applied to a plate surface from a specified direction in advance. In the case where an applicator using a bar coater, a roll coater, or a squeegee is used as an application unit of adhesive, the adhesive flows from an upstream side to a downstream side in a transfer direction while being widened. However, like the plural plates as disclosed in JP-A-2002-96477, in the case where the escape grooves of the adhesive are formed only in the bonded area of each of the plates which is directly bonded to another plate, part of the adhesive flowing from the upstream side in the transfer direction is applied also to a non-bonded area of the plate which is not directly bonded. There is a fear that the adhesive flows into the inside of the opening or hole (for example, through-hole in JP-A-2002-96477) formed in the non-bonded area.

The invention provides an escape groove in the non-bonded area, which is not bonded to another plate, of a plate constituting a flow path unit as well as in the bonded area to prevent adhesive from flowing into openings or holes formed in the non-bonded area.

According to one embodiment of the invention, an inkjet head includes a flow-path unit. The flow-path unit includes a plurality of plates that are stacked and define a common ink chamber and a plurality of ink flow paths communicating with the common ink chamber. The plurality of plates include a first plate and a second plate that are bonded to each other by an adhesive. The first plate defines a plurality of ink supply holes that make up a part of the ink flow paths. The first plate defines a first groove in a second region other than a first region where the first plate and the second plate contact with each other. The first groove extends in a direction, which intersects with a longitudinal direction of the inkjet head.

In the flow-path unit of the inkjet head, the common ink chamber and the ink flow paths communicating with the common ink chamber are formed. The plural plates define the common ink chamber and the ink flow paths. When the second plate is laminated to the first plate that defines the plural ink supply holes, the adhesive may be transferred to the first plate along the longitudinal direction of the inkjet head. As a result, the first and second plates are bonded.

The first plate defines the first groove in the second region other than the first region where the first plate and the second plate contact with each other. The first groove escapes the transferred adhesive. The first groove extends in the direction, which intersects with the longitudinal direction of the inkjet head. Therefore, if the adhesive is transferred in the first direction, the first groove defined in the section region escapes the adhesive that is flown in the first direction. As a result, the adhesive is prevented from flowing into the ink supply holes that are defined in the second region.

According to one embodiment of the invention, an inkjet head includes a flow-path unit. The flow-path unit includes a plurality of plates that are stacked and define a common ink chamber and a plurality of ink flow paths that communicate with the common ink chamber. One of the plurality of plates defines a plurality of ink supply holes on one surface thereof and a recess portion on the other surface thereof, and makes up one of walls of the common ink chamber. The recess portion, at a bottom surface thereof, communicates with at least one of the ink supply holes.

In this inkjet head, the flow-path unit includes the plural plates that are stacked and define the common ink chamber and the ink flow paths. The one of the plates makes up the one of the walls of the common ink chamber. The one of the plates defines the ink supply holes on the one surface thereof and a recess portion on the other surface thereof. The recess portion, at the bottom surface thereof, communicates with at least one of the ink supply holes.

As stated above, the at least one ink supply hole communicates with the bottom surface of the recess portion. Therefore, if the adhesive is transferred in the longitudinal direction, the adhesive flown in the longitudinal direction does not adhere to the peripheral portions of the ink supply holes. It is possible to prevent the adhesive from flowing into the plural ink supply holes.

BRIEF DESCRIPTION OF THE DRAWINGS

FIG. 8 is views showing an actuator unit, in which

DETAILED DESCRIPTION OF THE PREFERRED EMBODIMENT

Figure 1:
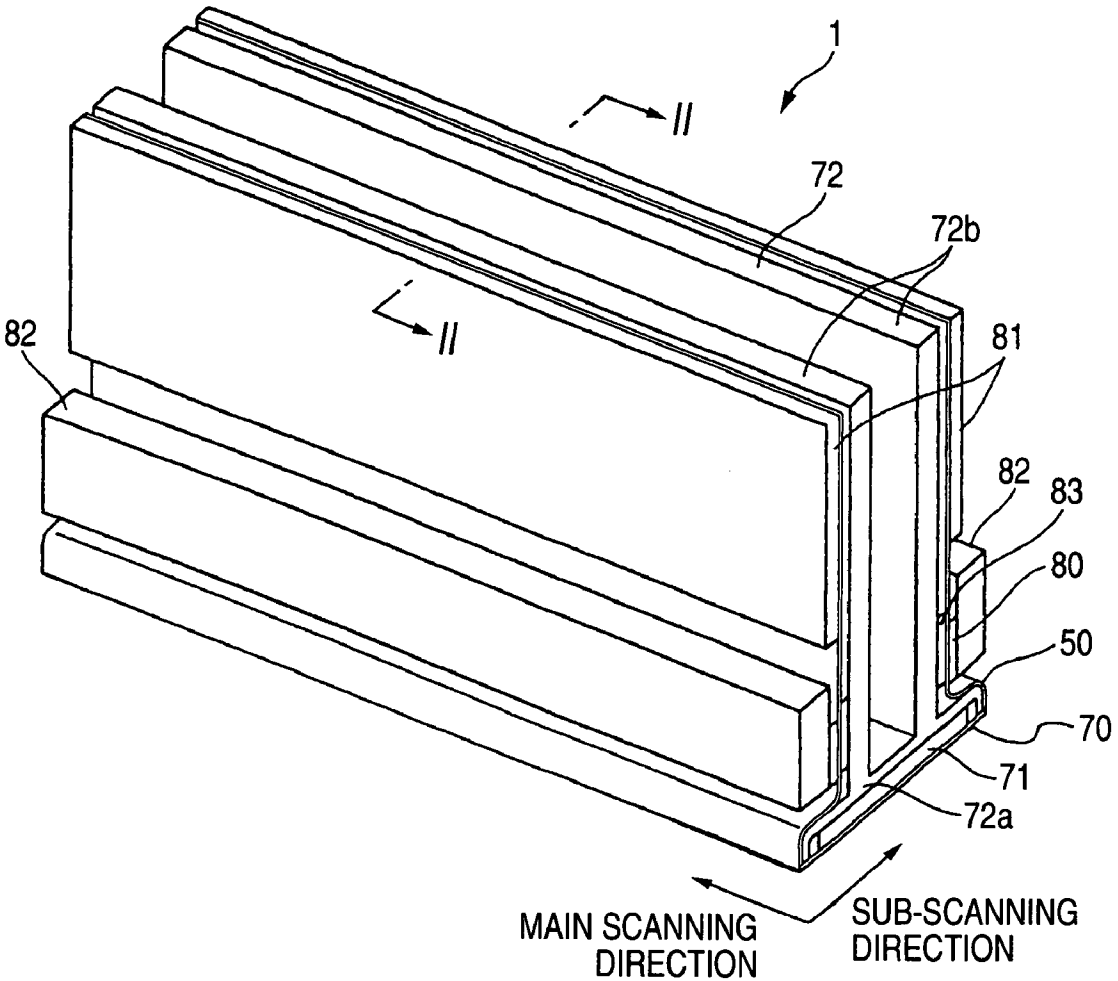
FIG. 1 is a perspective view of an inkjet head according to an embodiment of the invention.

An embodiment of the invention will be described. As shown in FIG. 1, an inkjet head 1 of this embodiment includes a head main body 70 and a base block 71. The head main body 70 ejects ink onto a sheet, extends in a main scanning direction, and has a rectangular plane shape. The base block 71 is disposed above the head main body 70. In the base block 71, two ink reservoirs 3 that function as flow paths of ink supplied to the head main body 70 are formed.

The head main body 70 includes a flow-path unit 4 in which the ink flow paths are formed, and plural actuator units 21 bonded to the upper surface of the flow-path unit 4. The flow-path unit 4 and the actuator units 21 are constructed such that plural thin plates are laminated and bonded to each other. A flexible printed circuit (FPC) 50 functioning as a feeding member is bonded to the upper surface of the actuator unit 21, and is led out to both sides. The base block 71 is made of metal material, for example, stainless. The ink reservoir 3 in the base block 71 is substantially a rectangular parallelepiped hollow area formed along the longitudinal direction of the base block 71.

A lower surface 73 of the base block 71 protrudes downward from a surrounding area, in the vicinity of an opening 3*b*. The base block 71 is in contact with the flow-path unit 4 only at a portion 73*a* near the opening 3*b* of the lower surface 73. Thus, an area other than the portion 73*a* near the opening 3*b* of the lower surface 73 of the base block 71 is separate from the head main body 70, and the actuator unit 21 is disposed in this separate portion.

The base block 71 is bonded and fixed to a recess formed in the lower surface of a grip part 72*a* of a holder 72. The holder 72 includes the grip part 72*a* and a pair of protrusions 72*b* that extend from the upper surface of the grip part 72*a* in a direction orthogonal to this and are spaced from each other by a specified interval. The FPC 50 bonded to the actuator unit 21 is arranged along the surface of each of the projections 72*b* of the holder 72 through an elastic member 83 such as a sponge. A driver IC 80 is disposed on the FPC 50 arranged on the surface of the projection 72*b* of the holder 72. In order to send a drive signal outputted from the driver IC 80 to the actuator unit 21 (described later in detail) of the head main body 70, the FPC 50 is electrically connected to the both of the drive IC 80 and the actuator unit 21 by soldering.

Since a heat sink 82 having substantially a rectangular parallelepiped shape is disposed to be in close contact with the outer surface of the driver IC 80, heat generated by the driver IC 80 can be efficiently dissipated. A board 81 is disposed above the driver IC 80 and the heat sink 82 and outside the FPC 50. Seal members 84 are respectively disposed between the upper surface of the heat sink 82 and the board 81, and between the lower surface of the heat sink 82 and the FC 50 to bond them.

Figure 3:
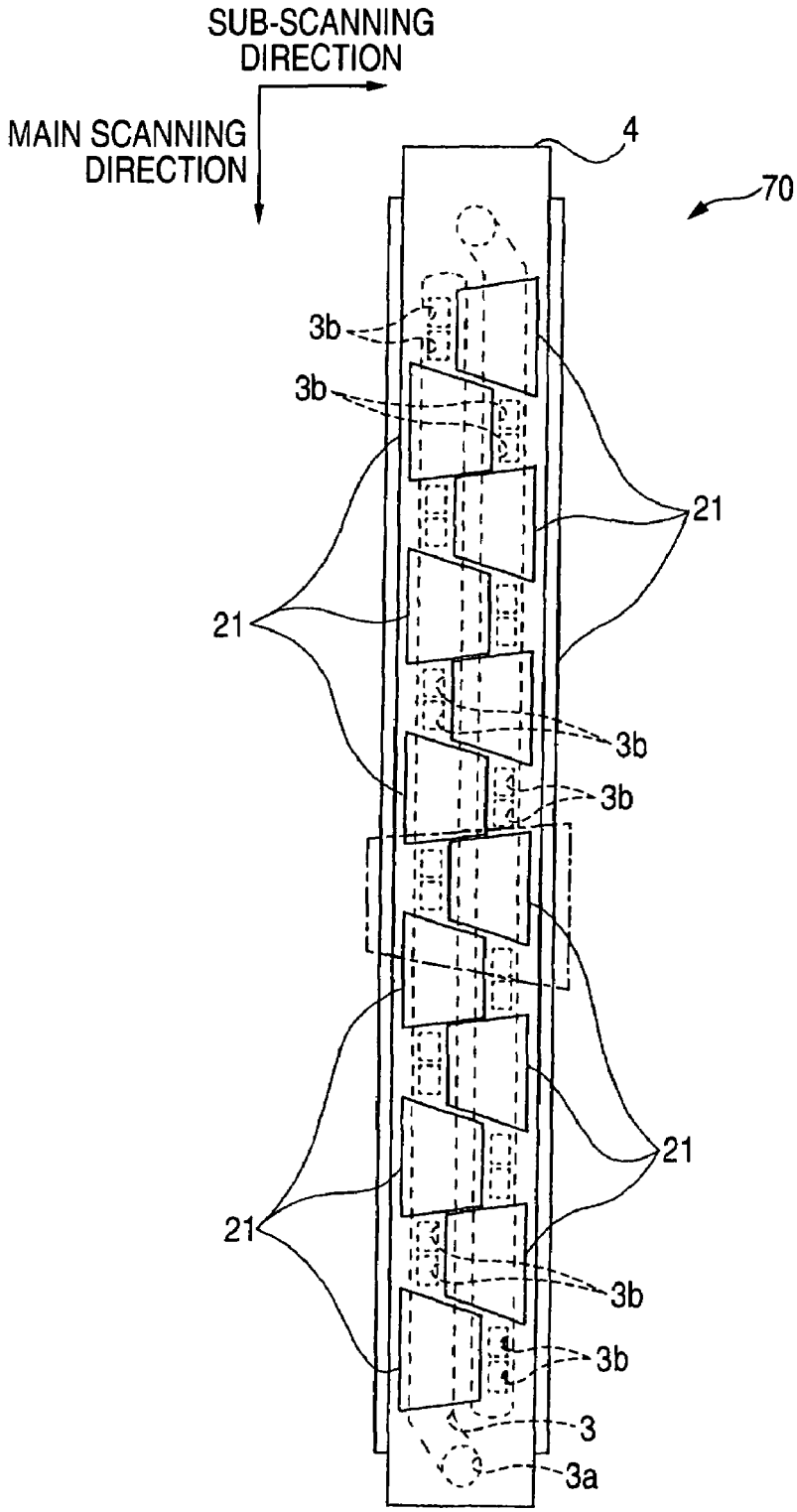
FIG. 3 is a plan view of a head main body.

FIG. 3 is a plan view of the head main body 70 shown in FIG. 1. In FIG. 3, the ink reservoirs 3 formed in the base block 71 are imaginarily shown by broken lines. The two ink reservoirs 3 extend in parallel to each other in the longitudinal direction of the head main body 70 and are spaced from each other by a specified interval. Each of the two ink reservoirs 3 has an opening 3*a* at one end and communicates with an ink tank (not shown) through this opening 3*a*, so that it is always filled with ink. The many openings 3*b* are provided in the respective ink reservoirs 3 in the longitudinal direction of the head main body 70, and connect the respective ink reservoirs 3 and the flow-path unit 4 as described above. The many openings 3*b* include pairs and the two openings of each of the pairs are disposed to be close to each other in the longitudinal direction of the head main body 70. The pairs of the openings 3*b* communicating with the one ink reservoir 3 and the pairs of the openings 3*b* communicating with the other ink reservoir 3 are arranged in a staggered manner.

In the areas where the openings 3*b* are not arranged, the plural actuator units 21 having trapezoidal shapes in the plan view are arranged in a staggered manner and in a pattern opposite to the pairs of the openings 3*b*. Parallel opposite sides (upper side and lower side) of each of the actuator units 21 are parallel to the longitudinal direction of the head main body 70. Parts of oblique sides of the adjacent actuator units 21 overlap with each other in a width direction of the head main body 70.

Figure 4:
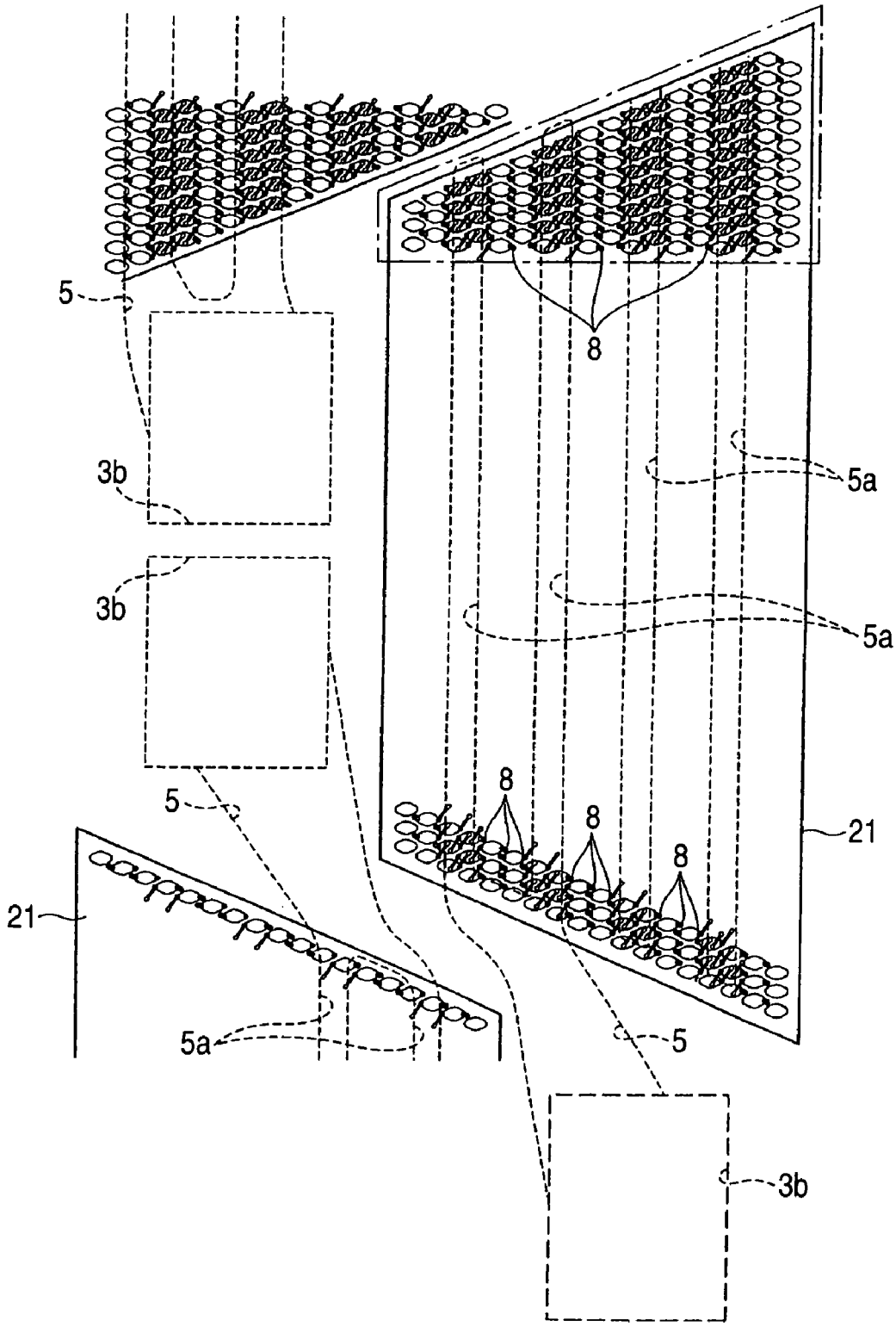
FIG. 4 is an enlarged view of an area surrounded by a one-dot chain line of FIG. 3.

FIG. 4 is an enlarged view of an area surrounded by a one-dot chain line drawn in FIG. 3. As shown in FIG. 4, the openings 3*b* provided for each of the ink reservoirs 3 communicate with manifolds 5 functioning as common ink chambers. A tip end of each of the manifolds 5 branches into two and forms sub-manifolds 5*a* functioning as common ink chambers. Besides, when viewed on a plane, the two sub-manifolds 5*a* branching from the adjacent opening 3*b*extend from each of the two oblique sides of the actuator unit 21. That is, under the actuator unit 21, the four sub-manifolds 5*a* separate from each other extend along the parallel opposite sides of the actuator unit 21.

The lower surface of the flow-path unit 4 corresponding to the bonding area of the actuator unit 21 is an ink ejection area. Many nozzles 8 are arranged in a matrix form on the surface of the ink ejection area as described later. For the purpose of simplifying the drawing, only some of the nozzles 8 are shown in FIG. 4, however, the nozzles 8 are actually disposed all over the ink ejection area.

Figure 5:
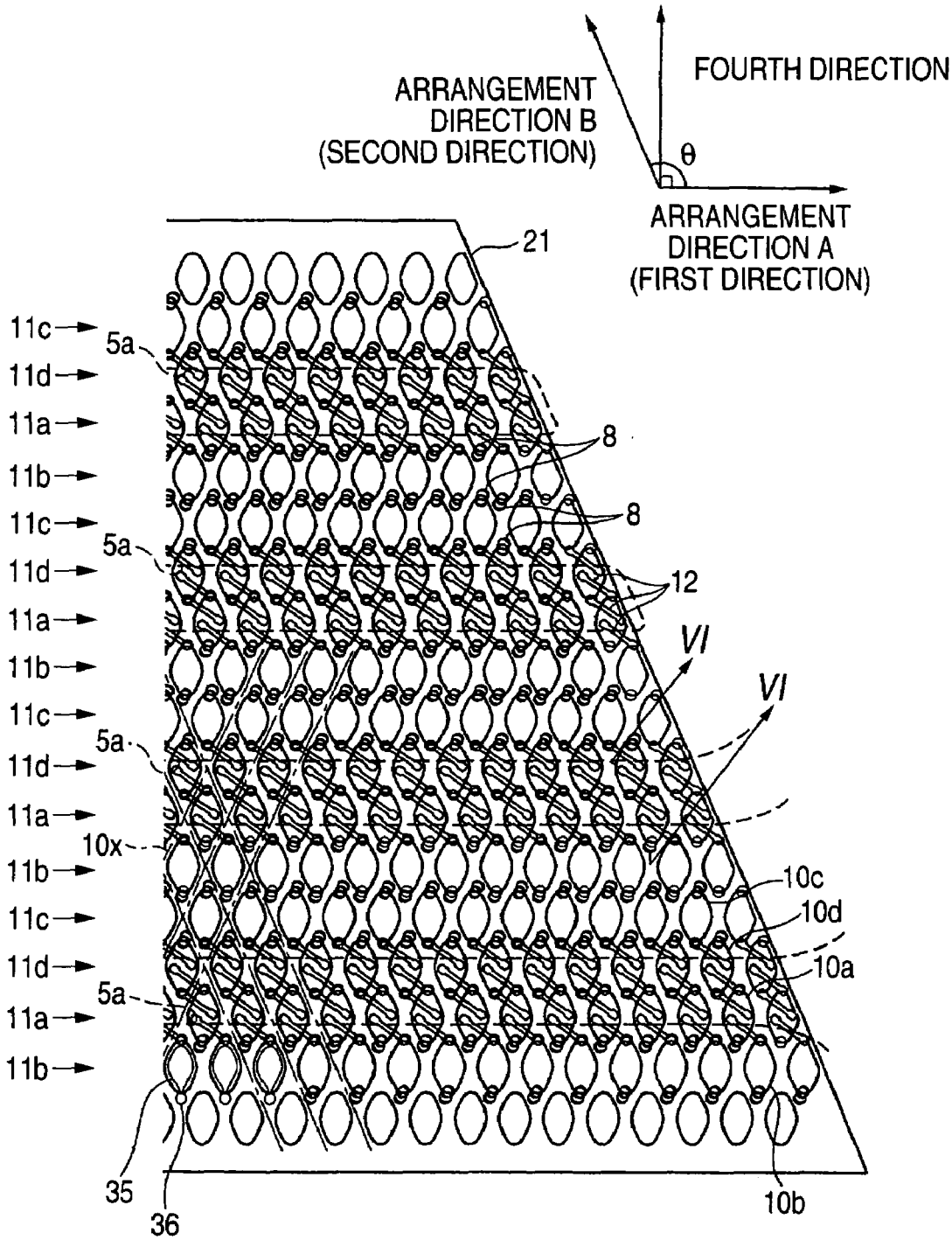
FIG. 5 is an enlarged view of an area surrounded by a one-dot chain line of FIG. 4.

FIG. 5 is an enlarged view of an area surrounded by a one-dot chain line shown in FIG. 4. FIGS. 4 and 5 show a state where a plane on which many pressure chambers 10 of the flow-path unit 4 are arranged in a matrix form is seen in a direction vertical to the ink ejection surface. Each of the pressure chambers 10 has a parallelogram shape in the plan view in which each corner part is curved and a longer diagonal thereof line is parallel to the width direction of the flow-path unit 4. One end of each of the pressure chambers 10 communicates with the nozzle 8. The other end thereof communicates with the sub-manifold 5*a* functioning as the common ink flow path through an aperture 12 (see FIG. 6). When viewed on a plane, at a position over lapping with each of the pressure chambers 10, an individual electrode 35 having a similar shape in the plan view to the pressure chamber 10 and one size smaller than the pressure chamber 10 is formed on the actuator unit 21. FIG. 5 shows only some of the many individual electrodes 35 to simplify the drawing. Incidentally, in FIGS. 4 and 5, for the purpose of making the drawings plain, the pressure chambers 10, the apertures 12 and the like which exist in the actuator unit 21 or the flow-path unit 4 and should be drawn by broken lines, are drawn by solid lines.

In FIG. 5, plural imaginary rhombic areas 10*x* in which the pressure chambers 10 (10*a*, 10*b*, 10*c*, 10*d*) are respectively contained are adjacently arranged in a matrix form in two directions, that is, an arrangement direction A and an arrangement direction B. Thus, the rhombic areas 10*x* do not over lap with one another and have the respective sides in common. The arrangement direction A is the longitudinal direction of the inkjet head 1, that is, the extension direction of the sub-manifold 5*a*, and is parallel to a short diagonal line of the rhombic area 10*x*. The arrangement direction B is a direction of one oblique line of the rhombic area 10*x* forming an obtuse angle θ with respect to the arrangement direction A. The pressure chamber 10 and the corresponding rhombic area 10*x* share the center position. Borderlines of the both are separate from each other when viewed on a plane.

The pressure chambers 10 adjacently arranged in a matrix form in the two directions of the arrangement direction A and the arrangement direction B are separate from each other by a distance equivalent to 37.5 dpi in the arrangement direction A. Besides, in one ink ejection area, 16 pressure chambers 10 are disposed in the arrangement direction B. The pressure chambers 10 at both ends in the arrangement direction B are dummy and do not contribute to ink ejection.

The plural pressure chambers 10 disposed in the matrix form constitute plural pressure chamber lines along the arrangement direction A as shown in FIG. 5. The pressure chamber lines are classified into a first pressure chamber line 11*a*, a second pressure chamber line 11*b*, a third pressure chamber line 11*c*, and a fourth pressure chamber line 11*d* according to the relative position to the sub-manifold 5*a* when viewed in a direction vertical to the paper surface of FIG. 5. These first to fourth pressure chamber lines 11*a* to 11*d* are periodically arranged in units of four in sequence of 11*c*→11*d*→11*a*→11*b*→11*c*→11*d*→ . . . →11*b* from the upper side of the actuator unit 21 to the lower side thereof.

In pressure chambers 10*a* constituting the first pressure chamber line 11*a* and pressure chambers 10*b* constituting the second pressure chamber line 11*b*, with respect to a direction orthogonal to the arrangement direction A when viewed in the direction vertical to the paper surface of FIG. 5, the nozzles 8 are unevenly distributed on the lower side of the paper surface of FIG. 5. The nozzles 8 are respectively positioned at the lower ends of the corresponding rhombic areas 10*x*. On the other hand, in pressure chambers 10*c* constituting the third pressure chamber line 11*c* and pressure chambers 10*d* constituting the fourth pressure chamber line 11*d*, with respect to the fourth direction, the nozzles 8 are unevenly distributed on the upper side of the paper surface of FIG. 5. The nozzles 8 are respectively positioned at the upper ends of the corresponding rhombic areas 10*x*. In the first and fourth pressure chamber lines 11*a* and 11*d*, when viewed in the direction vertical to the paper surface of FIG. 5, half or more of the pressure chambers 10*a* and 10*d* overlap with the sub-manifold 5*a*. In the second and third pressure chamber lines 11*b* and 11*c*, none of areas of the pressure chambers 10*b* and 10*c* overlap with the sub-manifold 5*a*. Thus, with regard to the pressure chamber 10 belonging to any pressure chamber line, while the nozzle 8 communicating with this pressure chamber 10 does not overlap with the sub-manifold 5*a*, the width of the sub-manifold 5*a* is formed as wide as possible. As a result, ink can be smoothly supplied to the respective pressure chambers 10.

Figure 6:
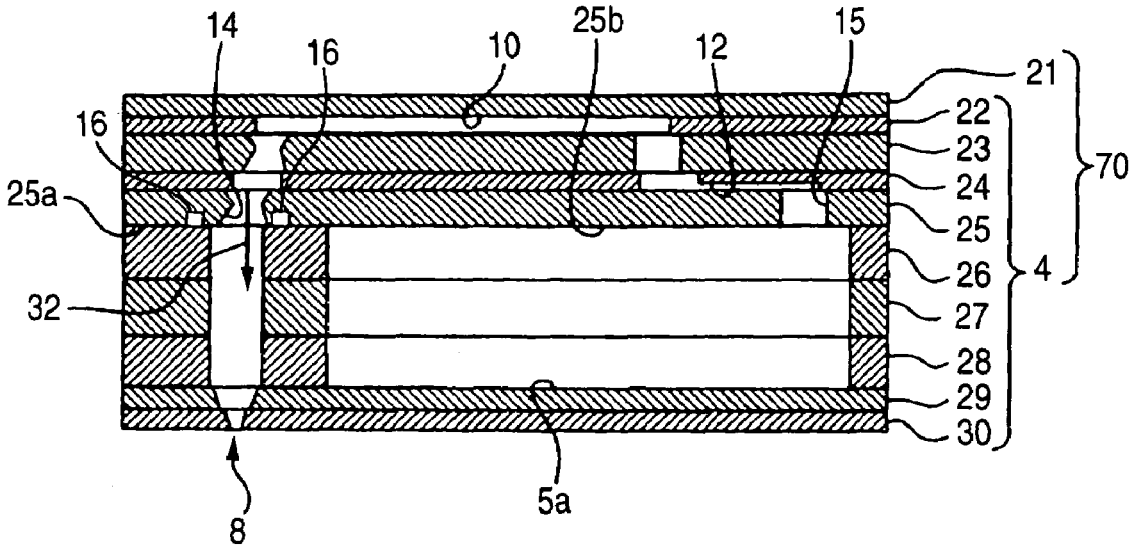
FIG. 6 is a sectional view taken along line VI-VI of FIG. 5.

Next, a sectional structure of the head main body 70 will be further described with reference to FIGS. 6 and 7. As shown in FIG. 6, each of the nozzles 8 communicates with the sub-manifold 5*a* through the pressure chamber 10 and the aperture 12. In this way, an individual ink path 32 extending from an outlet of the sub-manifold 5*a* through an ink supply hole 15, the aperture 12, the pressure chamber 10 and a communication hole 14 to the nozzle 8 is formed for each of the pressure chambers 10.

As shown in FIG. 6, the pressure chamber 10 and the aperture 12 are provided at different depths in the lamination direction of plural thin plates. According to this configuration, as shown in FIG. 5, in the flow-path unit 4 corresponding to the ink ejection area under the actuator unit 21, the aperture 12 communicating with one pressure chamber 10 can be arranged at the same position as another pressure chamber 10 adjacent to the one pressure chamber 10 when viewed on a plane. As a result, since the pressure chambers 10 are arranged closely and at high density, high resolution image printing can be realized by the inkjet head 1 having a relatively small occupied area.

Figure 7:
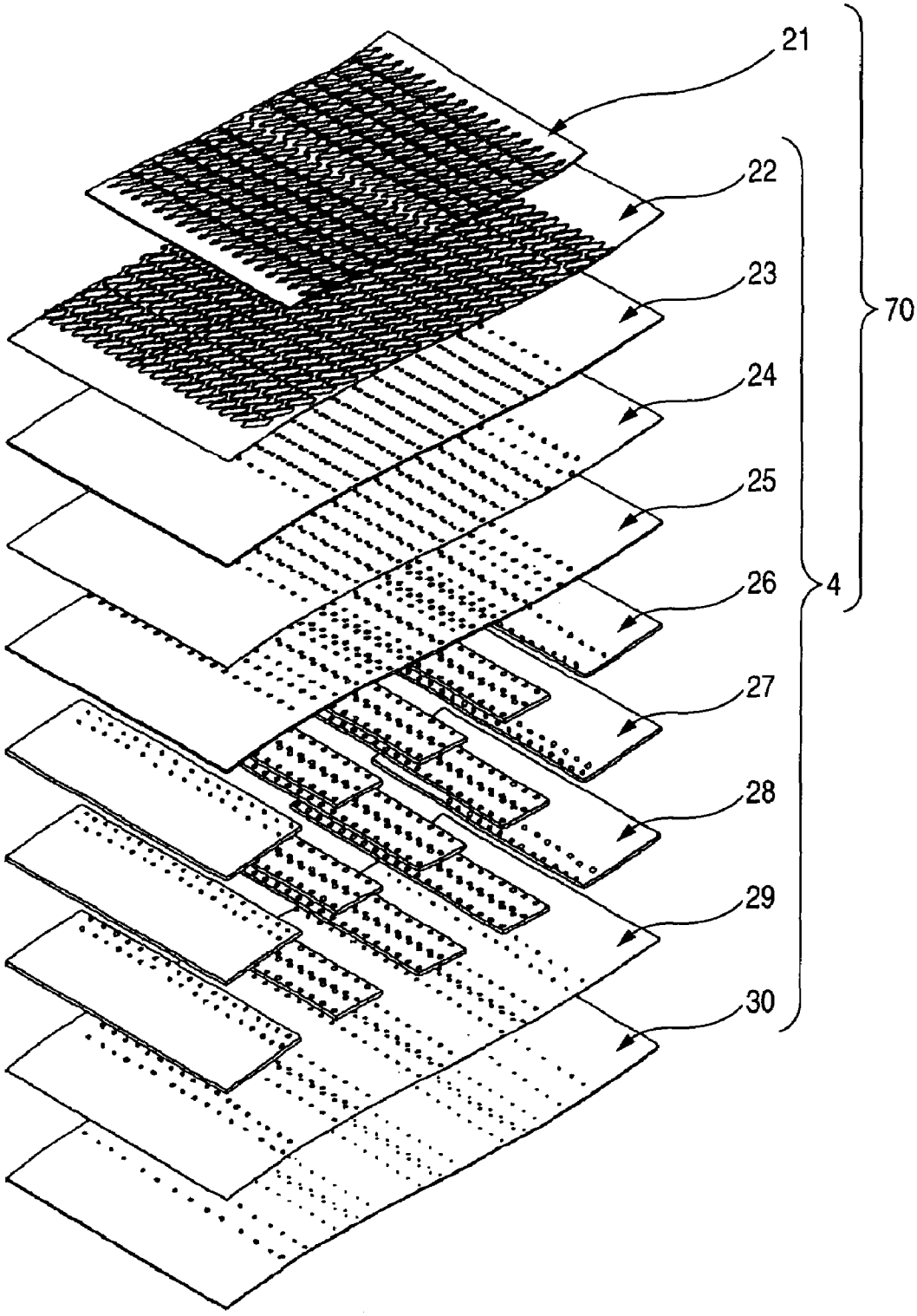
FIG. 7 is a partial exploded perspective view of a head main body.

As shown in FIG. 7, the head main body 70 has a lamination structure in which ten sheet-like members in total, that is, an actuator unit 21, a cavity plate 22, a base plate 23, an aperture plate 24, a supply plate 25, manifold plates 26, 27 and 28, a cover plate 29 and a nozzle plate 30 from the top are laminated. Among these, the nine plates except the actuator unit 21 constitute the flow-path unit 4.

As described later, the actuator unit 21 is configured such that four piezoelectric sheets 41 to 44 (see FIG. 8A) are laminated. An electrode is disposed thereon so that only the uppermost layer thereof is a layer (hereinafter simply referred to as "a layer including an active layer") having a portion which becomes an active layer at the time of electric field application, and the three remaining layers are non-active layers. The cavity plate 22 is a metal plate in which many substantially rhombic openings corresponding to the pressure chambers 10 are provided. The base plate 23 is a metal plate in which with respect to one of the pressure chambers 10 of the cavity plate 22, a communication hole between the pressure chamber 10 and the aperture 12 and a communication hole between the pressure chamber 10 and the nozzle 8 are provided. The aperture plate 24 is a metal plate in which with respect to one of the pressure chambers 10 of the cavity plate 22, in addition to the aperture 12 formed of two holes and a half-etched area to connect them, a communication hole from the pressure chamber 10 to the nozzle plate 8 is provided. The supply plate 25 is a metal plate in which with respect to one of the pressure chambers 10 of the cavity plate 22, the ink supply hole 15 communicating the aperture 12 with the sub-manifold 5*a* and the communication hole 14 from the pressure chamber 10 to the nozzle 8 are provided. The manifold plates 26, 27 and 28 are metal plates in which with respect to one of the pressure chambers 10 of the cavity plate 22, in addition to the sub-manifold 5*a*, communication holes from the pressure chamber 10 to the nozzle 8 are provided. The cover plate 29 is a metal plate in which with respect to one of the pressure chambers 10 of the cavity plate 22, a communication hole from the pressure chamber 10 to the nozzle plate 8 is provided. The nozzle plate 30 is a metal plate in which with respect to one of the pressure chambers 10 of the cavity plate 22, the nozzle 8 is provided.

These ten sheets 21 to 30 are positioned and laminated to each other so that the individual ink path 32 as shown in FIG. 6 is formed. The individual ink flow path 32 first goes upward from the sub-manifold 5*a* through the ink supply hole 15, extends horizontally in the aperture 12, further goes upward, extends horizontally again in the pressure chamber 10, slightly goes obliquely downward in a direction of moving away from the aperture 12, and goes vertically downward toward the nozzle 8.

Figure 8A:
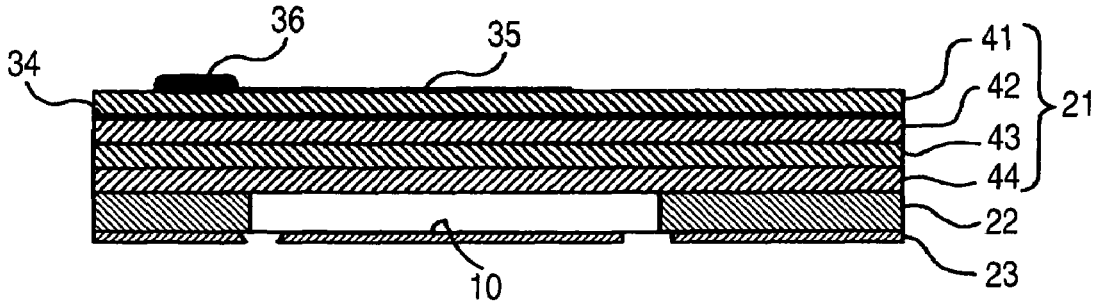
FIG. 8A is a sectional view of the actuator unit.
Figure 8B:
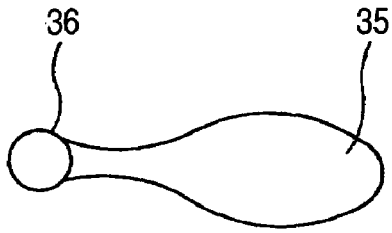
FIG. 8B is a plan view showing an individual electrode.

Next, a structure of the actuator unit 21 laminated on the cavity plate 22 of the uppermost layer of the flow-path unit 4 will be described. FIG. 8A is a partial enlarged sectional view of the actuator unit 21 and the pressure chamber 10. FIG. 8B is a plan view showing a shape of the individual electrode 35 bonded to the surface of the actuator unit 21.

As shown in FIG. 8A, the actuator unit 21 includes the four piezoelectric sheets 41 to 44 each formed to have a same thickness of about 15 μm. These piezoelectric sheets 41 to 44 are continuous laminar flat plates (continuous flat plate layers) arranged to extend over the many pressure chambers 10 formed in one ink ejection area of the head main body 70. The piezoelectric sheets 41 to 44 are arranged, as the continuous flat plate layers, to extend over the many pressure chambers 10, so that the individual electrodes 35 can be arranged on the piezoelectric sheet 41 at high density by using, for example, a screen printing technique. Thus, the pressure chambers 10 formed at positions corresponding to the individual electrodes 35 can also be arranged at high density. Also, printing of a high resolution image becomes possible. The piezoelectric sheets 41 to 44 are made of ceramic material of lead zirconate titanate (PZT) having ferroelectricity.

The individual electrode 35 is formed on the piezoelectric sheet 41 of the uppermost layer. A common electrode 34 formed on the whole surface of the sheet and having a thickness of about 2 μm intervenes between the piezoelectric sheet 41 of the uppermost layer and the lower piezoelectric sheet 42. Both the individual electrode 35 and the common electrode 34 are made of metal material such as Ag—Pd.

The individual electrode 35 has a thickness of approximately 1 μm. As shown in FIG. 8B, the individual electrode 35 has substantially a rhombic shape in the plan view almost similar to the pressure chamber 10 shown in FIG. 5. One of acute angle parts of the substantially rhombic individual electrode 35 is extended, and its end is provided with a circular land part 36 electrically connected to the individual electrode 35 and having a diameter of about 160 μm. The land part 36 is made of, for example, gold containing glass frit. As shown in FIG. 8A, the land part 36 is bonded onto the surface of an extension part of the individual electrode 35.

Figure 2:
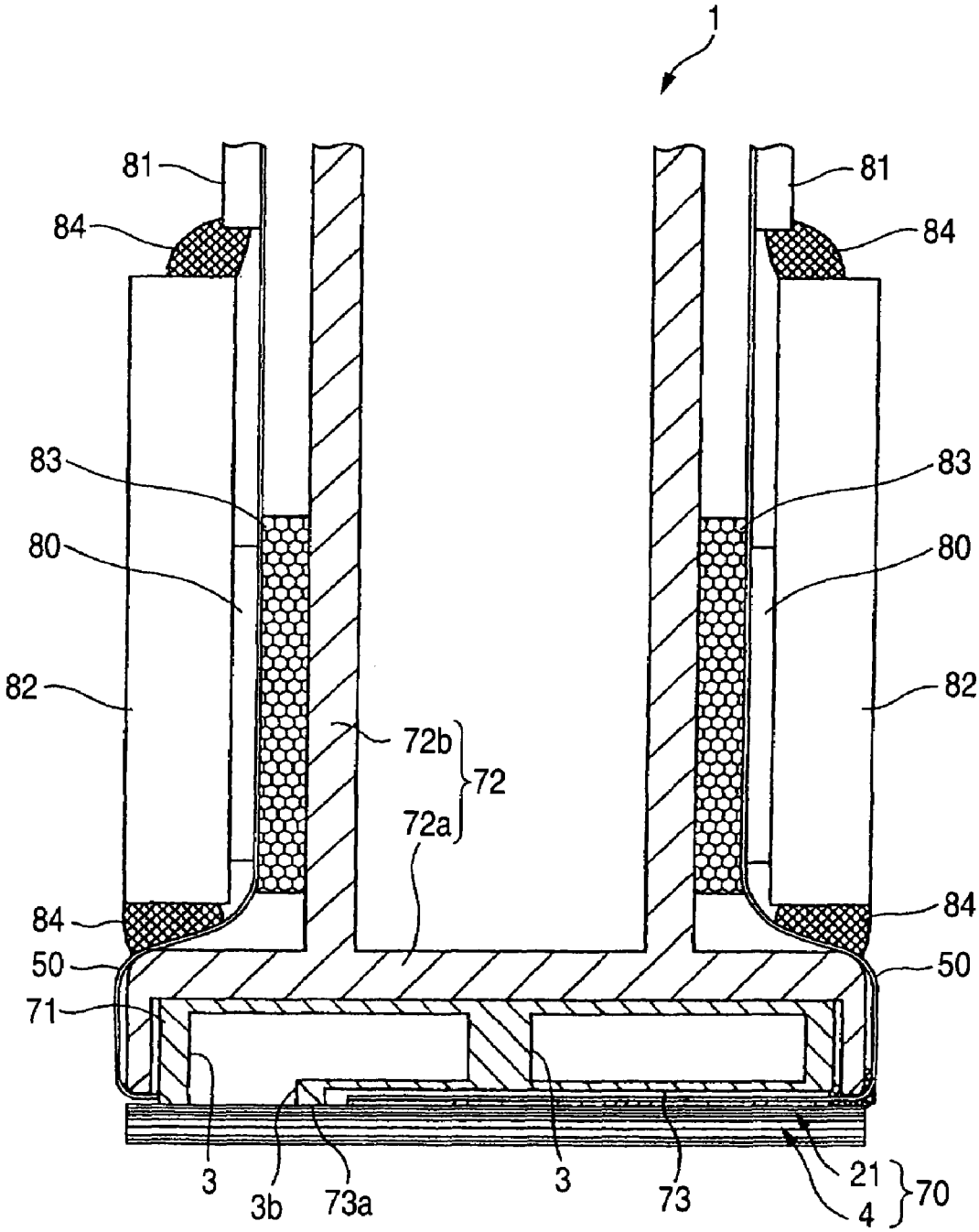
FIG. 2 is a sectional view taken along line II-II of FIG. 1.

The common electrode 34 is grounded at a not-shown area. With this configuration, the common electrode 34 is equally kept at the ground potential in the areas corresponding to all the pressure chambers 10. Besides, the individual electrodes 35 are connected to the driver IC 80 through the FPC 50 including different lead lines independent for the respective individual electrode 35. Thus, the potentials of the respective individual electrodes 35 corresponding to the respective pressure chambers 10 can be controlled (see FIGS. 1 and 2).

Next, the driving method of the actuator unit 21 will be described. The polarization direction of the piezoelectric sheet 41 of the actuator unit 21 is its thickness direction. That is, the actuator unit 21 has a so-called unimorph type structure in which the upper (that is, far from the pressure chamber 10) one piezoelectric sheet 41 is made a layer in which an active layer exists, and the lower (that is, close to the pressure chamber 10) three piezoelectric sheets 42 to 44 are made non-active layers. Accordingly, when the individual electrode 35 is made to have a specified positive or negative potential, for example, when the electric field and the polarization are in the same direction, the electric field application portion of the piezoelectric sheet 41 sandwiched between the electrodes functions as the active layer (pressure generation part), and shrinks in the direction normal to the polarization direction according to a piezoelectric transverse effect. On the other hand, since the piezoelectric sheets 42 to 44 are not influenced by the electric field, they are not spontaneously varied. Thus, a difference occurs in distortion in the direction vertical to the polarization direction between the piezoelectric sheet 41 of the upper layer and the piezoelectric sheets 42 to 44 of the lower layers. The whole of the piezoelectric sheets 41 to 44 is deformed to protrude toward the non-active side (unimorph deformation) At this time, as shown in FIG. 8A, since the lower surface of the piezoelectric sheets 41 to 44 is fixed to the upper surface of the separation wall (cavity plate) 22 for defining the pressure chamber 10, eventually, the piezoelectric sheets 41 to 44 are deformed to protrude toward the pressure chamber side. Thus, the volume of the pressure chamber 10 is decreased, the pressure of ink is raised, and the ink is ejected from the nozzle 8. Thereafter, when the individual electrode 35 is returned to have the same potential as the common electrode 34, the piezoelectric sheets 41 to 44 are returned to have the original shape. The volume of the pressure chamber 10 is returned to the original volume. Therefore, ink is sucked from the manifold 5 side.

Another driving method including the following steps may be adopted. The individual electrode 35 is previously made to have a potential different from the common electrode 34. The individual electrode 35 is once made to have the same potential as the common electrode 34 each time an ejection request is made. The individual electrode 35 can be made again to have the potential different from the common electrode 34 at specified timing. In this case, the piezoelectric sheets 41 to 44 are returned to have the original shape at the timing when the individual electrode 35 and the common electrode 34 have the same potential. Thus, the volume of the pressure chamber 10 is increased as compared with the initial state (state where the potentials of both the electrodes are different from each other), and ink is sucked from the manifold 5 side into the pressure chamber 10. Thereafter, the piezoelectric sheets 41 to 44 are deformed to protrude toward the pressure chamber 10 side at the timing when the individual electrode 35 is made again to have the potential different from the common electrode 34. The volume of the pressure chamber 10 is decreased. Thus, the pressure to the ink is raised, and the ink is discharged.

The actuator unit 21 and the plural plates 22 to 30 constituting the flow-path unit 4 shown in FIGS. 6 and 7 are bonded by adhesive and are laminated to each other. That is, after the adhesive is transferred onto one surface of the plate by a bonding tool or a roller, another plate to be bonded to the plate is stuck. At this time, in order to prevent the adhesive from flowing into openings or holes respectively formed in the plates 22 to 30 and constituting part of the individual ink flow path 32, plural escape grooves are defined in a bonded area of the two laminated plates. The bonded area includes at least regions surrounded by two-dot dash lines shown in FIG. 10 and a region outside curved lines shown in FIG. 9 (almost right half of FIG. 9).

Figure 9:
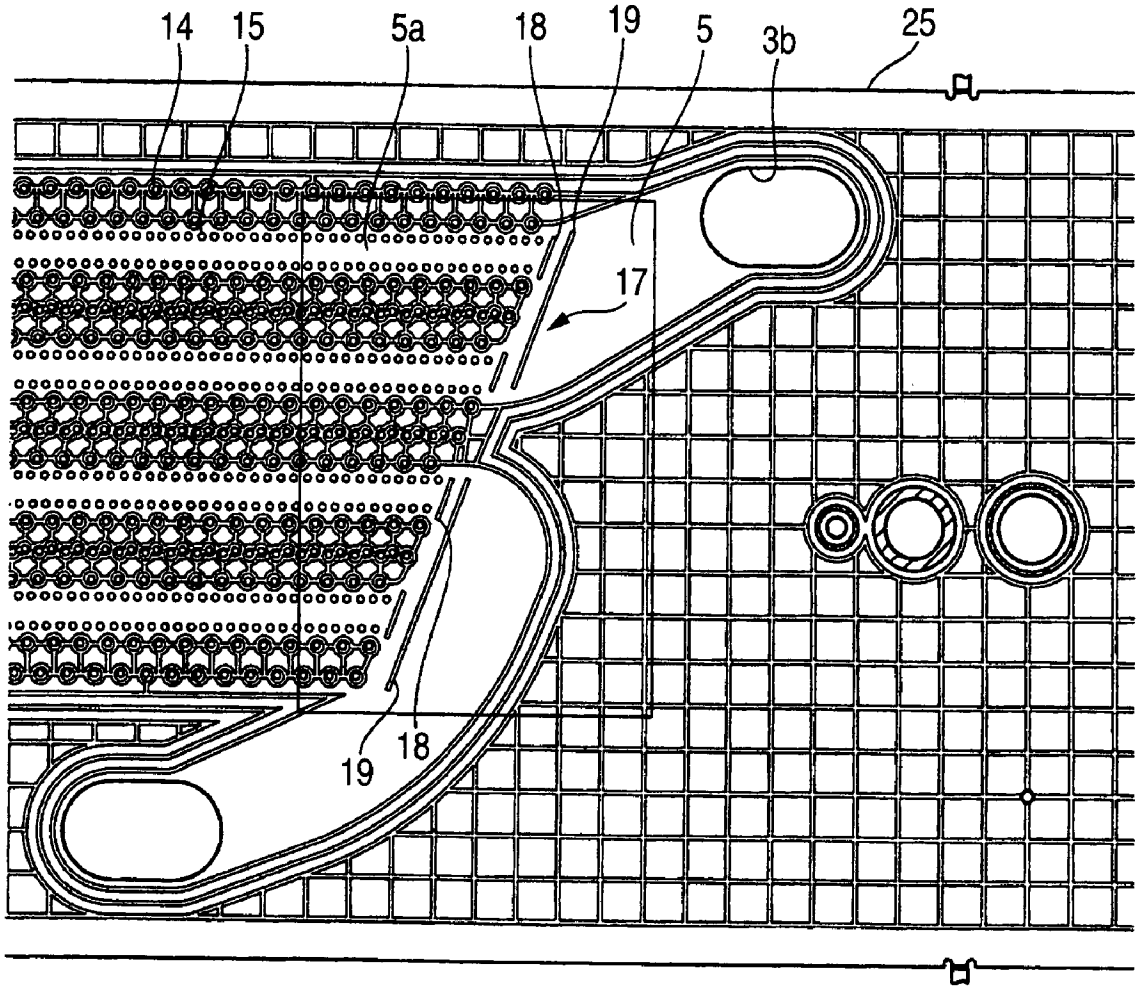
FIG. 9 is a view showing a supply plate seen from a back side.
Figure 10:
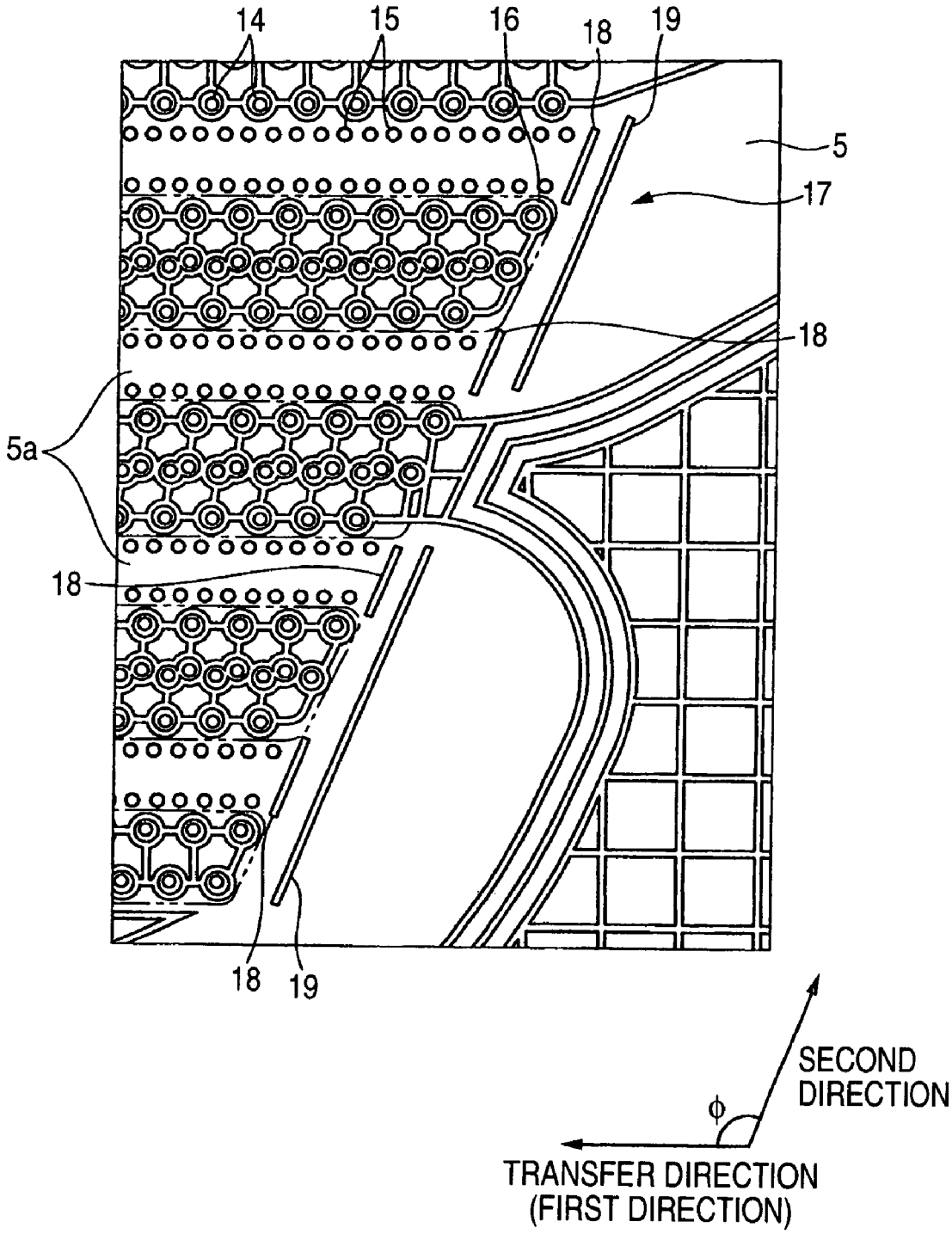
FIG. 10 is an enlarged view showing apart in a rectangular frame of FIG. 9.

Here, among the plural plates 22 to 30, especially the supply plate 25 (firs plate) that constitutes the upper wall of the sub-manifold 5*a* and defines the plural ink supply holes 15, will be described with reference to FIGS. 9 and 10. FIG. 9 is a view showing the supply plate 25 seen from the back surface (lower surface) side. This supply plate 25 defines the plural ink supply holes 15 and the plural communication holes 14. The ink supply holes 15 constitute part of the individual ink flow paths 32 and communicating the sub-manifold 5*a* with the apertures 12. The communication holes 14 constitute part of the individual ink flow paths 32 and communicating the pressure chambers 10 with the nozzles 8 are formed.

The plural communication holes 14 are arranged in four lines at positions corresponding to the four pressure chamber lines 11*a* to 11*d* of FIG. 5, in the longitudinal direction of the flow path unit 4. As shown in FIG. 6, a peripheral portion of the plural communication holes 14 is a bonded areas 25*a* to be bonded to the lower manifold plate 26 (second plate), and is the area in which the application of adhesive is required. Thus, plural circular escape grooves 16 are formed in the peripheral portions of the plural communication holes 14. The plural circular escape grooves 16 respectively surround the communication holes 14 and prevent the surplus adhesive that is moved at the time of bonding from flowing into the communication holes 14. These plural circular escape grooves 16 are formed in such a state that the circular escape grooves 16 are communicated with each other.

On the other hand, the plural ink supply holes 15 are arranged in two lines in the longitudinal direction of the flow path unit 4 at positions corresponding to the sub-manifold 5*a*. As shown in FIGS. 6, 9 and 10, the peripheral portions of these plural ink supply holes 15 face the sub-manifold 5*a* that functions as the common ink chamber. Accordingly, the peripheral portion of the ink supply holes 15 is a non-bonded area 25*b* (see FIG. 6) that is not bonded to the lower manifold plate 26, and the application of adhesive to the portion is not required.

However, in the case where the two plates of the supply plate 25 and the manifold plate 26 are bonded together, the adhesive is transferred to the back surface side of the supply plate 25 by a roll coater or a bar coater. The transfer direction of the adhesive at that time is the longitudinal direction (first direction) of the flow path unit 4 in view of easiness of transfer. At this time, although the adhesive flows from the upstream side in the first direction to the downstream side, there is a fear that the adhesive also flows from the upstream side in the first direction to the non-bonded area 25*b* where the application of adhesive is not required, and that the adhesive flows into the plural ink supply holes 15.

Then, in this supply plate 25, an escape part 17, that escape the adhesive transferred in the first direction for bonding the manifold plate 26 to the supply plate 25, is formed in the non-bonded area 25*b* outside the bonded area 25*a* of the two plates. This escape part 17 includes escape grooves 18 and escape groove 19. The escape grooves 18 discretely extend in a second direction having an angle with respect to the first direction and are formed at upstream portions in the first direction with respect to the plural ink supply holes 15. The escape groove 19 continuously extends in the second direction and is formed at an upstream portion in the first direction with respect to the escape grooves 18. Incidentally, although the escape grooves 18 and 19 are separated from each other in FIGS. 9 and 10, the escape grooves 18 and 19 may communicate with each other.

That is, with respect to two lines of the ink supply holes 15 provided for each of the four sub-manifolds 5*a*, the one escape groove 18 is formed at the upstream portion in the first direction with respect to the ink supply holes 15 so that the escape groove 18 overlaps partially with at least the two lines of the ink supply holes 15 when viewed from the upstream side in the first direction. Further, with respect to the two escape grooves 18 each corresponding to the two lines of the ink supply holes 15 on the upper side in FIGS. 9 and 10, when viewed from the upstream side in the first direction, the escape groove 19 is continuously formed so that the escape groove 19 overlaps with the two escape grooves 18. Also with respect to the two lower escape grooves 18 in FIGS. 9 and 10, similarly, the escape groove 19 is continuously formed so that the escape groove 19 overlaps with the escape grooves 18 when viewed from the upstream side in the first direction.

Accordingly, the adhesive flowing from the upstream side in the first direction is first made to escape to the continuously extending escape groove 19 formed at the upstream side in the first direction. Since the escape groove 19 is formed to be relatively long and continuous, the volume of the groove is large, and a large amount of adhesive can be made to escape. Further, in the case where the adhesive can not be completely made to escape by the escape groove 19, the adhesive is made to escape to the escape groove 18 formed at the downstream side in the first direction with respect to the escape groove 19. As stated above, the two kinds of the escape grooves 18 and 19 can certainly escape the adhesive flowing into the peripheral portion of the ink supply holes 15, that is the non-bonded area 25*b*.

According to the inkjet head 1 as described above, following effects are obtained.

The escape part 17 for escaping the adhesive transferred in the first direction is formed in the peripheral portion of the plural ink supply holes 15, which is the non-bonded area 25*b* outside the area where the supply plate 25 and the manifold plate 26 are bonded, does not require the application of the adhesive, and is not directly bonded to another plate. The escape part 17 includes the two kinds of the escape grooves 18 and 19 extending in the second direction at the upstream portions in the first direction with respect to the ink supply holes 15. Accordingly, the two kinds of the escape grooves 18 and 19 escape the adhesive flowing toward the non-bonded area 25*b* from the upstream side in the first direction. It is possible to prevent the adhesive from flowing into the plural ink supply holes 15. Further, the escape groove 19 exists near the upstream side of the bonded area 25*a* where the communication holes 14 are formed. Thus, there does not occur such a state that among the escape grooves 16 functioning to prevent the surplus adhesive from flowing into the communication holes 14 at the time of bonding of the supply plate 25 and the manifold plate 26, especially the escape groove 16 positioned at the upstream side is filled with the adhesive before bonding, and that the original escape effect of such escape groove 16 for the adhesive required at the time of bonding is damaged.

The two kinds of the escape grooves 18 and 19 are formed as follows. The escape grooves 18 are, with respect to the two lines of the ink supply holes 15 provided to correspond to each of the four sub-manifolds 5*a*, discretely formed to partially overlap with at least the ink supply holes 15 when viewed from the upstream side in the first direction. The escape groove 19 is, at the upstream portion in the first direction with respect to the escape grooves 18, continuously formed to overlap with the two escape grooves 18 when viewed from the upstream side in the first direction.

Thus, after most of the adhesive flowing from the upstream side in the first direction is made to escape by the escape groove 19 having a relatively long length and a large groove volume, the adhesive which can not be completely made to escape by this escape groove 19 can be made to escape by the escape grooves 18 formed at the downstream side. By this, it is possible to prevent the adhesive from flowing into the ink supply holes 15 opening to the non-bonded area 25*b*. In other words, even if the adhesive flows into the non-bonded area 25*b*, it can be prevented that the adhesive flows into the ink supply hole 15 and clogs up the ink supply hole 15. Therefore, the supply amount of ink to the individual ink flow paths 32 communicating with these ink supply holes 15 becomes uniform.

Next, modified examples in which various modifications are applied to the foregoing embodiment will be described. However, the same structures as those of the embodiment are denoted by the same symbols and their explanation will be omitted.

Figure 11:
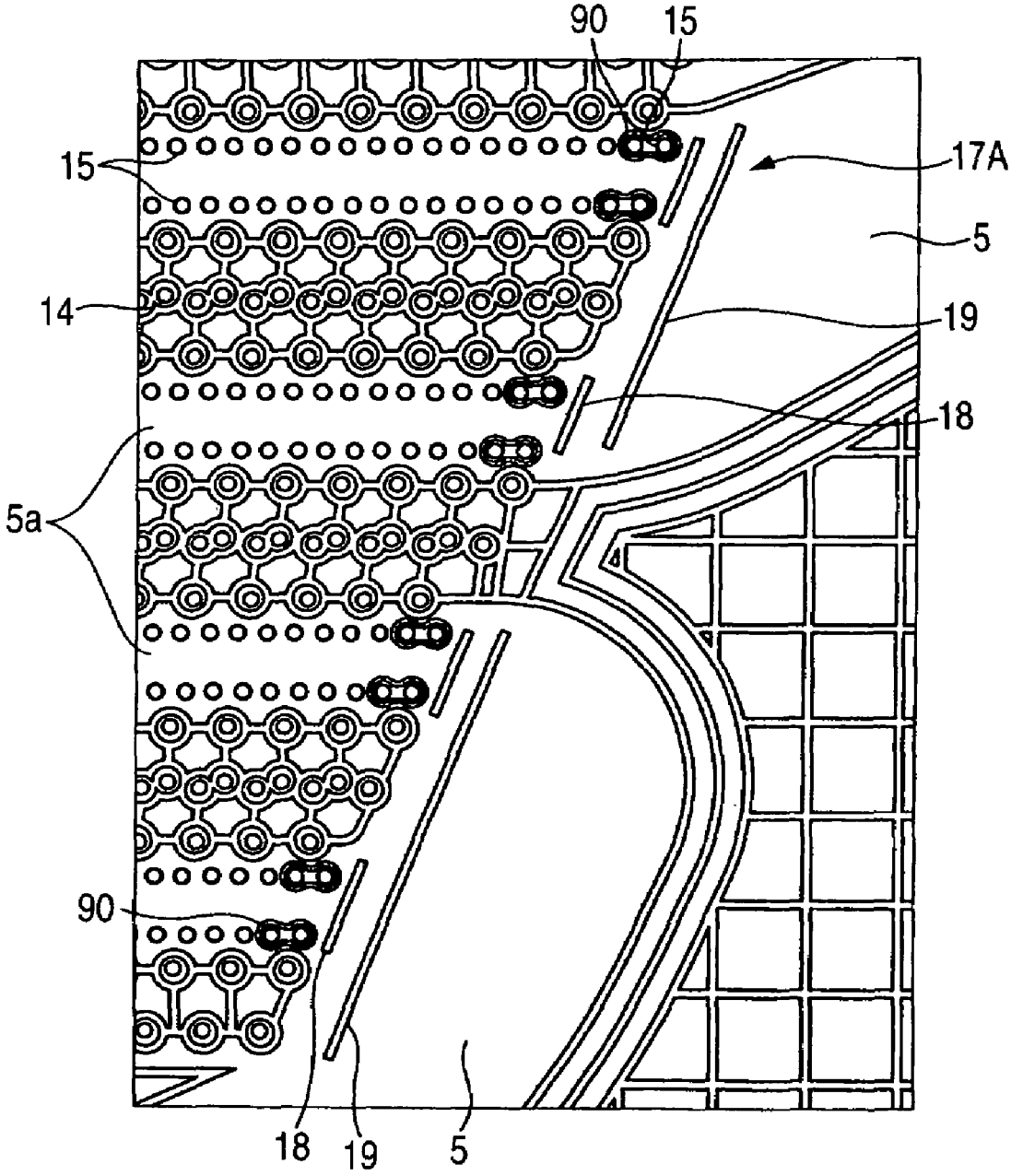
FIG. 11 is a view showing a modified example and corresponding to FIG. 10.

1] As shown in FIG. 11, an escape part 17A may include, in addition to the two kinds of the escape grooves 18 and 19 of the foregoing embodiment, circular escape grooves 90 each surrounding one or plural ink supply holes 15 positioned at an upstream side in a first direction among plural ink supply holes 15. As stated above, even if the adhesive flowing from the upstream side in the first direction can not be completely made to escape by the two kinds of the escape grooves 18 and 19, the adhesive is made to escape by the circular escape grooves 90. Therefore, it is possible to prevent the adhesive from flowing into the upstream side ink supply holes 15 into which the adhesive is apt to flow. In FIG. 11, the circular escape groove 90 surrounding the two upstream side ink supply holes 15 is provided. However, the circular escape groove 90 may be provided for only the most upstream side ink supply hole 15, or the circular escape groove 90 may be provided for three or more ink supply holes 15.

On the contrary, when the adhesive is transferred to the supply plate 25 and the amount of adhesive flowing from the upstream side in the first direction is not very large, one of the two kinds of the escape grooves 18 and 19 constituting the escape part 17 may be omitted.

Figure 12:
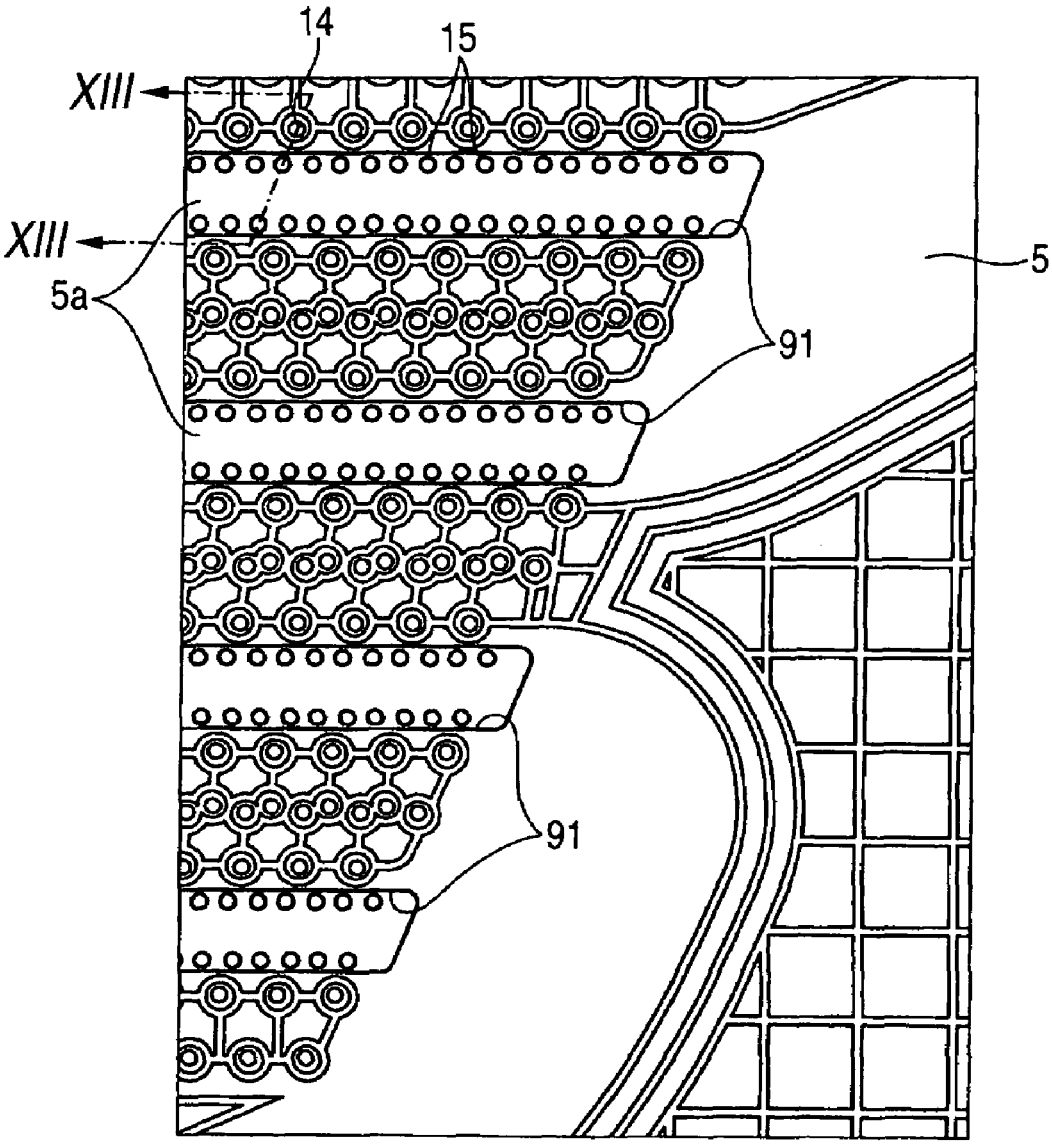
FIG. 12 is a view showing another modified example and corresponding to FIG. 10.
Figure 13:
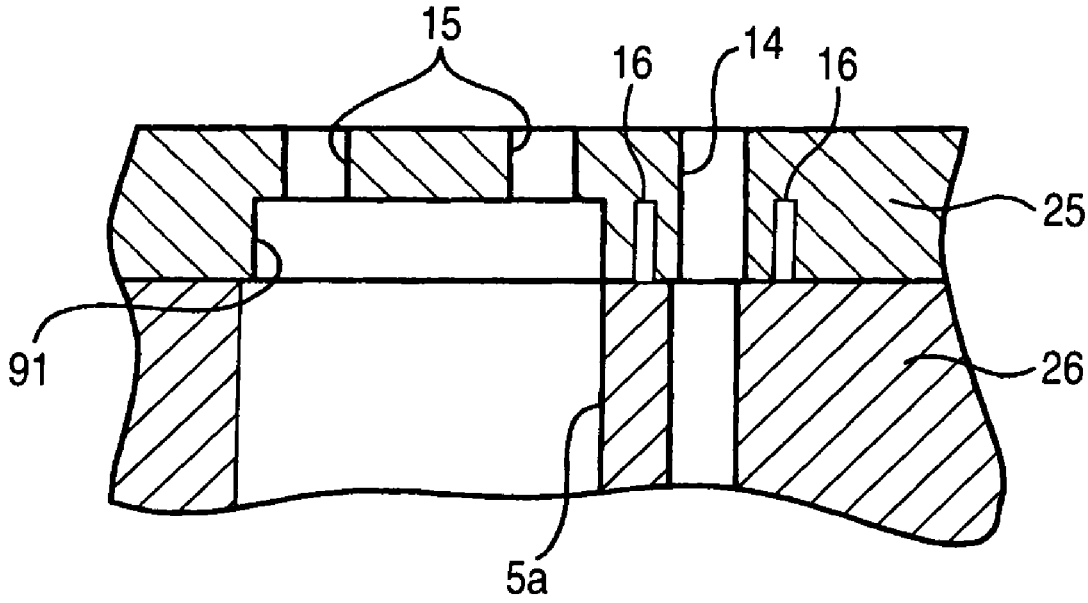
FIG. 13 is a partial sectional view showing a supply plate and a manifold plate in another modified example.
Figure 15:
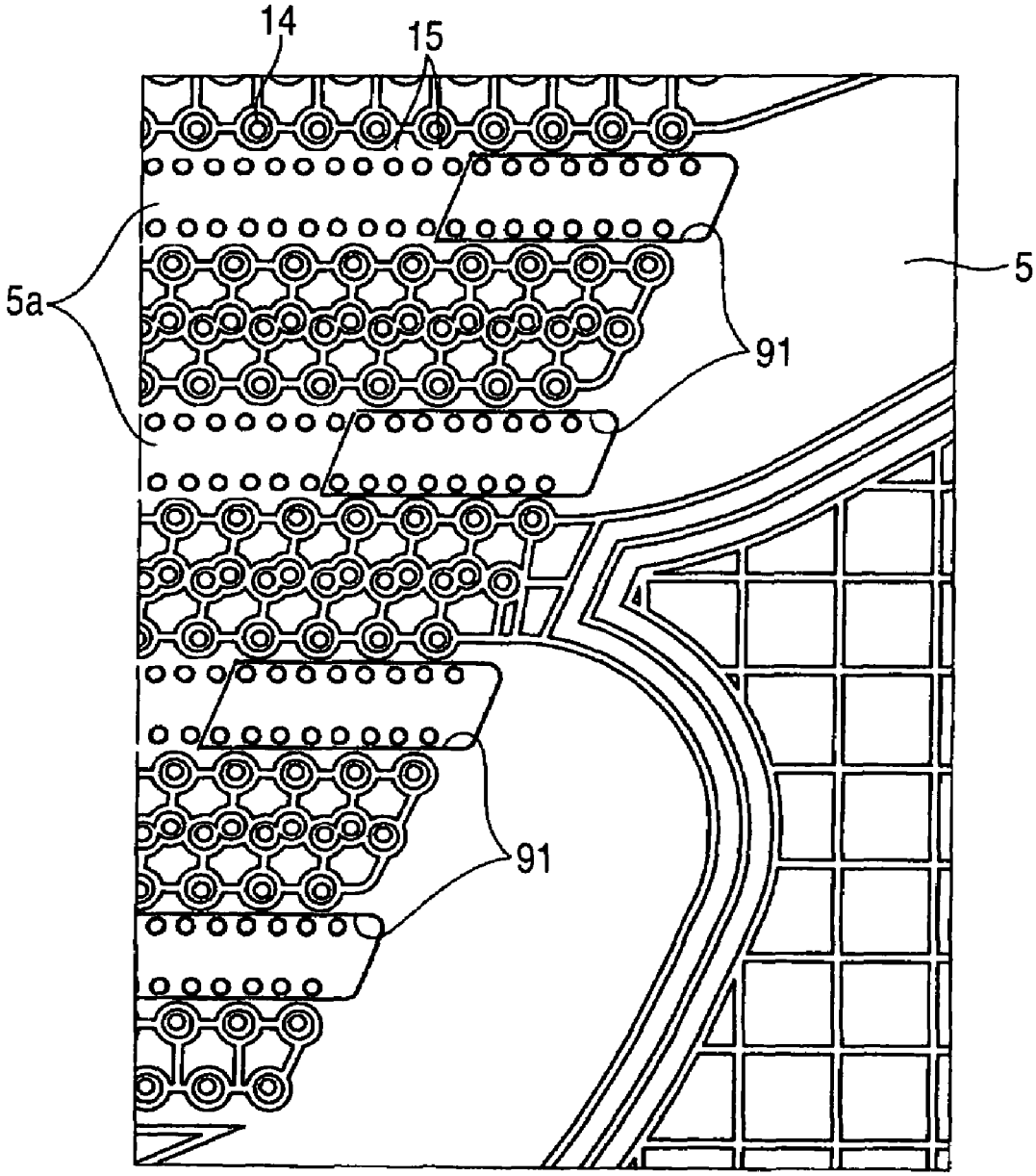
FIG. 15 is a view showing another modified example and corresponding to FIG. 12.

2] As shown in FIGS. 12 and 13, recess portions 91 are recessed upward and extend in the first direction. The recess portions 91 are formed of a half-etched area in a portion of a supply plate 25 facing the sub-manifold 5*a* that functions as a common ink chamber. It is noted that the supply plate 25 forms an upper wall of the sub-manifold 5*a*. The plural ink supply holes 15 arranged in two lines may communicate with an inner end (upper end of FIG. 13) of the recess portions 91. With this configuration, even if the adhesive flows to the non-bonded area 25*b* facing the sub-manifold 5*a* from the first direction that is the upstream side of the transfer direction, the recess portions 91 prevent the adhesive from flowing into the ink supply holes 15 that is continuous with the inner end of the recess portions 91. It is noted that the recess portions 91 may communicate with a part of the ink supply holes 15 as shown in FIG. 15. If the recess portions 91 communicates with the ink supply holes 15 that are located on the upstream side in the first direction, the recess portion 91 also can prevent the adhesive from flowing into the communicated ink supply holes 15. Since the recess portions 91 escape the adhesive sufficiently, there is no fear that the adhesive flows into the downstream ink supply holes 15 that do not communicate with the recess portions 91.

3] The foregoing embodiment may be modified as described below. In this modified example, similarly to the foregoing embodiment, a non-bonded area 25*b* in which application of adhesive is not required and which is not directly bonded to another plate is formed outside an area where a supply plate 25 and a manifold plate 26 are bonded together. Plural ink supply holes 15 communicating with pressure chambers 10 through apertures 12 are opened in this non-bonded area 25*b*. Escape parts 17 that escape adhesive transferred in the first direction are formed at peripheral portions of the plural ink supply holes 15. The escape part 17 is the same as that of the foregoing embodiment in that at the upstream side in the first direction with respect to the ink supply holes 15, the escape part 17 includes at least the discretely arranged escape grooves 18 of the two kinds of escape grooves 18 and 19 extending in the second direction crossing the first direction.

Figure 14:
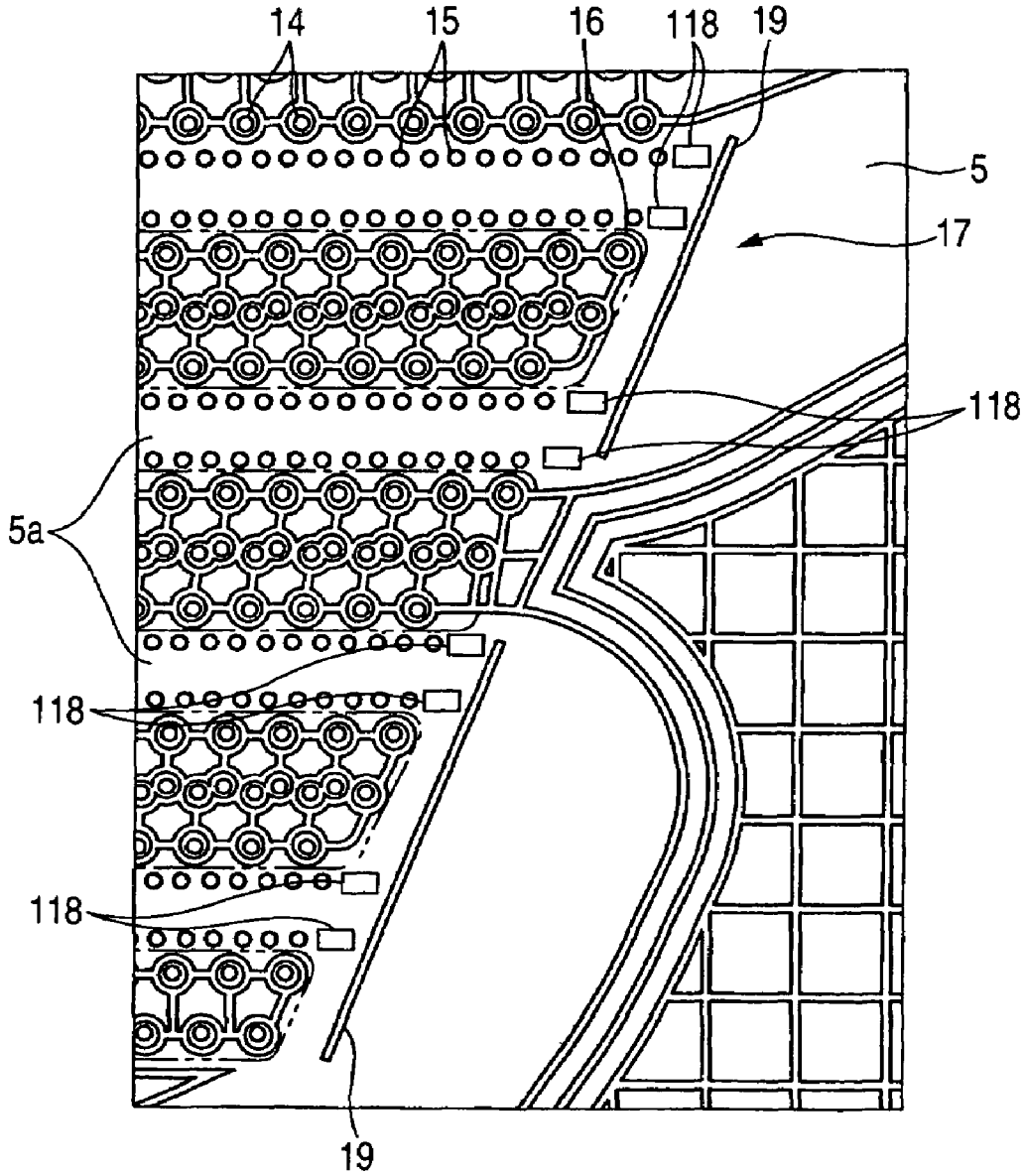
FIG. 14 is a view showing another modified example and corresponding to FIG. 10.

Here, in this modified example, instead of the escape grooves 18, escape grooves 118 discretely arranged in the second direction may be formed as shown in FIG. 14. The escape grooves 118 extend in the first direction. Further, the plural escape grooves 18 may include such an escape groove 18 that the ink supply holes 15 are arranged on the extension line in its extension direction. In the case where adhesive necessary for bonding the supply plate 25 and the manifold plate 26 is applied to the supply plate 25, the amount of adhesive flowing into the ink supply holes 15 and the number of ink supply holes damaged by this adhesive are determined in accordance with the amount of adhesive remaining in an area from an upstream portion in the first direction to the ink supply hole 15 arranged at the most upstream side.

On the other hand, in this modified example, the plural escape grooves 18 extending in the first direction as the transfer direction of the adhesive are formed at the upstream side of the non-bonded area 25*b* in which the plural ink supply holes 15 are formed. Therefore, the adhesive widened from the upstream side can be more effectively made to flow into the escape grooves 18. Besides, it is possible to certainly prevent the adhesive from flowing into the upstream side ink supply hole 15 into which the adhesive is apt to flow. Especially, to extend the escape groove 18 in the arrangement direction of the ink supply holes 15 is effective in the following case. In the case where the direction of the flow of ink in the sub-manifold 5*a* is coincident with the extension direction of the escape groove 18, the flow of ink in the sub-manifold 5*a* is not prevented, and remaining of bubbles is prevented. Incidentally, also in this modified example, it is needless to say that the escape part 17 can be constructed in combination with the foregoing circular escape groove 90 surrounding the ink supply hole 15, or the escape groove 19 continuously formed to overlap with both the bonded area and the non-bonded area when viewed in the first direction.

In the above description, the examples have been described in which the invention is applied to the supply plate 25 forming the ink supply holes 15 communicating the sub-manifolds 5*a* with the apertures 12. However, the invention can be applied to, among the plural plates 22 to 30 forming the individual ink flow paths 32, another plate having a non-bonded area in which adhesive is not directly transferred. For example, the invention may be applied to the base plate 23 facing the pressure chamber 10 or the aperture plate 24 forming the aperture 12 as shown in FIG. 6.

What is claimed is:

1. An inkjet head comprising:

a flow-path unit including a plurality of plates that are stacked and define a common ink chamber and a plurality of ink flow paths communicating with the common ink chamber, wherein:

the plurality of plates include a first plate and a second plate that are bonded to each other by an adhesive;

the first plate defines a plurality of ink supply holes that make up a part of the ink flow paths and defines a first groove at least in a region where the first plate and the second plate do not contact each other, and the first groove is located in the region that is formed only in a part of the region; and the first groove extends in a direction, which intersects with a longitudinal direction of the inkjet head;

a plurality of nozzles;

a plurality of pressure chambers; and each of the plurality of ink flow paths extends from the common ink chamber through a corresponding one of the plurality of pressure chambers so as to communicate with a corresponding one of the plurality of nozzles.

2. The inkjet head according to claim 1, wherein the first groove escapes the adhesive, which is transferred along the longitudinal direction of the inkjet head.

3. The inkjet head according to claim 1, wherein the first groove extends continuously.

4. The inkjet head according to claim 3, wherein:

the first plate defines a plurality of second grooves between the first groove and the plurality of ink supply holes; and the plurality of second grooves are separated from each other.

5. The inkjet head according to claim 4, wherein the plurality of second grooves extend in the direction that intersects with the longitudinal direction of the inkjet head.

6. The inkjet head according to claim 4, wherein the plurality of second grooves extend in the longitudinal direction of the inkjet head.

7. The inkjet head according to claim 4, wherein the first groove communicates with the plurality of second grooves.

8. The inkjet head according to claim 1, wherein the first groove includes a plurality of first grooves, which are separated from each other.

9. The inkjet head according to claim 1, wherein the first groove extends straightly.

10. The inkjet head according to claim 1, wherein:

the plurality of ink supply holes are arranged in at least one line in the longitudinal direction of the inkjet head; and if a virtual line is drawn along the at least one line of the plurality of ink supply holes, the virtual line intersects with the first groove.

11. The inkjet head according to claim 1, wherein:

the plurality of ink supply holes are arranged in plural lines in the longitudinal direction of the inkjet head; and distances between the plurality of ink supply holes that are positioned at one ends of the at least one line and the first groove are equal to each other.

12. The inkjet head according to claim 1, wherein the first plate defines a circular groove that surrounds a hole group including at least one of the plurality of ink supply holes.

13. The inkjet head according to claim 12, wherein:

the plurality of ink supply holes are arranged in line in the longitudinal direction of the inkjet head; and the hole group includes the ink supply hole located at one end of the line.

14. The inkjet head according to claim 1, wherein:

the first plate defines a recess portion on one surface thereof;

the first groove is defined on the one surface of the first plate;

the ink supply holes are defined on the other surface of the first plate; and the recess portion communicates with the ink plurality of supply holes at a bottom surface of the first plate.

15. The inkjet head according to claim 14, wherein the one surface of the first plate is bonded to the second plate.

16. The inkjet head according to claim 1, wherein:

the first plate forms one of wall of the common ink chamber;

the plurality of ink supply holes communicate with the common ink chamber;

the first groove is defined in a region that is in a vicinity of the plurality of ink supply holes, faces the common ink chamber, and an adhesive is not applied.

17. The inkjet head according to claim 1, wherein only a portion of the first plate is bonded to a portion of the second plate, portions of the first and second plate that are not bonded to each other forming a non-bonded region between the first plate and the second plate.

18. The inkjet head according to claim 1, wherein:

the second plate has an opening, and the groove overlaps with the opening in plan view.

19. An inkjet head comprising:

a flow-path unit including a plurality of plates that are stacked and define a common ink chamber and a plurality of ink flow paths that communicate with the common ink chamber, wherein:

one of the plurality of plates defines a plurality of ink supply holes on one surface thereof and a recess portion on the other surface thereof, and forms a wall of the common ink chamber; and the recess portion, at a bottom surface of the one of the plurality of plates, communicates with at least one of the plurality of ink supply holes;

a plurality of nozzles;

a plurality of pressure chambers; and each of the plurality of ink flow paths extends from the common ink chamber through a corresponding one of the plurality of pressure chambers that is different from the common ink chamber so as to communicate with a corresponding one of the plurality of nozzles, wherein the plurality of ink supply holes communicate with the common ink chamber through the recessed portion.

20. The inkjet head according to claim 19, wherein:

the plurality of ink supply holes are arranged in line in a longitudinal direction of the inkjet head; and the recess portion communicates with the at least one of the plurality of ink supply holes that is located at one end of the line of the ink supply holes.

21. The inkjet head according to claim 19, wherein:

the second plate has an opening, and the groove overlaps with the opening in plan view.

22. An inkjet head comprising:

a flow-path unit including a plurality of plates that are stacked and define a common ink chamber and a plurality of ink flow paths communicating with the common ink chamber;

a plurality of nozzles; and a plurality of pressure chambers, wherein each of the plurality of ink flow paths extends from the common ink chamber through a corresponding one of the plurality of pressure chambers so as to communicate with a corresponding one of the plurality of nozzles, wherein the plurality of plates include a first plate and a second plate stacked on the first plate, wherein the first plate includes a first surface that faces the second plate, wherein the first surface includes a first region that is bonded to the second plate and a second region that is not bonded to the second plate, and wherein the first plate includes a first groove formed only in a part of the second region of the first surface.

* * * * *